United States Patent [19]

Wade et al.

[11] Patent Number: 4,522,517

[45] Date of Patent: Jun. 11, 1985

[54] ENCODER SYSTEM FOR DOT MATRIX LINE PRINTER

[76] Inventors: Kenneth B. Wade, 804 N. 3rd St., Battle Ground, Wash. 98604; Phillip R. Luque, 4172 Creswell Way, Boise, Id. 83704

[21] Appl. No.: 551,662

[22] Filed: Nov. 10, 1983

[51] Int. Cl.[3] ..... B41J 19/30

[52] U.S. Cl. ..... 400/322; 340/870.37; 364/559; 400/320; 400/705.1

[58] Field of Search ..... 400/320, 322, 323, 705.1; 340/870.37; 364/559, 661

[56] References Cited

U.S. PATENT DOCUMENTS

| | | | |
|---|---|---|---|
| 3,938,113 | 2/1976 | Dobson et al. | 400/126 X |
| 3,961,318 | 6/1976 | Farrand et al. | 340/870.37 |
| 4,332,492 | 6/1982 | Thern et al. | 400/322 X |
| 4,423,417 | 12/1983 | Tanaka et al. | 340/870.37 |

OTHER PUBLICATIONS

*IBM Tech. Disc. Bulletin,* by D. R. Dobson et al, vol. 21, No. 1, Jun. 1978, pp. 242–243, 340–870.37, "Position Encoder".

*Digital Design,* "RF Technology for a Matrix Printer", by Robert Kulterman, vol. 6, No. 6, Jun. 1976, pp. 42–46, 400–322.

*Primary Examiner*—Paul T. Sewell

[57] ABSTRACT

A linear capacitive encoder is utilized for detecting and encoding the position of a movable member such as a print bar in a dot matrix impact printer. An eight-phase signal is capacitively coupled to one plate of a linear capacitor mounted on the movable print bar. When the print bar moves the phase of the coupled signal changes with respect to the phase of the signal on the other plate of the capacitor, producing an analog signal representing incremental movements of the print bar. The analog signal is amplified and filtered and then converted to a TTL signal representing the position of the print bar. Present position of the print bar is compared to previous position of the print bar to derive signals representing the present direction of movement, direction change and incremental movements of 0.001". Built-in error or hysteresis is added to the direction and direction change signals to prevent false direction changes due to noise. The 0.001" signal and the direction change signal input a microprocessor which generates print position command signals at a selected dot density based on data stored in an output table which takes into account print hammer flight time and compensates for the sinusoidal motion of the print bar. An absolute reference point is established by the processor at each direction change of the print bar motion.

15 Claims, 10 Drawing Figures

ENCODER SYSTEM FOR DOT MATRIX LINE PRINTER

BACKGROUND OF INVENTION

1. Field of the Invention

The present invention relates generally to position measuring systems and particularly to dot matrix impact printers in which it is necessary to very accurately measure the position of a moving print bar.

2. Description of Prior Art

Impact printers employ individual hammers mounted in a hammer bank to impact an ink ribbon against print paper supported by a platen to effect printing. The printing can be formatted in different schemes such as in the dot matrix fashion where the printed characters are comprised of a series of dots made by the hammers impacting on the print paper. The print paper generally is stepwise advanced each time a line of dots is printed. The hammer bank may be shuttled transversely to the print paper to optimize usage of the individual hammers. One example of a currently available dot matrix impact printer is provided by the Hewlett-Packard Model HP 2608S.

Impact dot matrix printers require a means to measure the relative position of the print bar with respect to the print paper in order to provide timing signals to energize the individual hammer at the proper time to place a dot on the print paper. There are several generally accepted techniques to accomplish this function.

One example is provided by U.S. Pat. No. 4,203,678, Nordstrom et al, "Electronic Control Circuit for a High Speed Bidirectional Printer", issued on May 20, 1980. In the high speed printer of this patent the print head is laterally displaced along a print line by a stepper motor and prints characters comprised of a series of dots. An encoder is coupled to the output shaft of the stepper motor to generate count pulses when the stepper motor displaces the print head. The count pulses are then used by the control circuitry to continuously define print head lateral position.

A second technique utilizes a magnetic velocity transducer and magnetic or optical vane or position sensor. The velocity transducer is so mounted that it measures the velocity of the print bar with respect to the main mechanicsm (the platen is part of this main mechanism). The velocity transducer produces an analog voltage proportional to the velocity which is integrated to produce an analog voltage proportional to print bar position with respect to the (platen) main mechanism. This voltage is then processed by an analog to digital (A/D) converter to provide timing signals. The position sensor generates a home or neutral position signal for periodically zeroing the integrator. Several disadvantages are inherent to this technique. It is difficult to produce a velocity transducer with the required linearity, particularly if the print bar motion spans multiple character positions and utilizes a single print element to print several characters. Adjustments are required to compensate for transducer to transducer variations and gain variations in the integrator. The home position sensor must be mechanically and/or electrically adjusted so that its signal corresponds to the print bar neutral or zero position. In addition, magnetic velocity transducers must be precisely aligned when they are mounted and are sensitive to stray magnetic fields which are common in impact printers.

A third technique uses an optical linear encoder mounted between the print bar and the main mechanism. The linear encoder generally consists of a linear bar pattern printed on a glass or plastic strip or a linear bar pattern composed of slots in a metallic strip and an assembly which includes a light source, apperture plate and light sensors. The strip usually is mounted on the moving print bar and the pickup assembly is mounted on the main mechanism. When the print bar is in motion, the encoder produces pulses corresponding to the position of the print bar. Since the encoder output pulse pattern is fixed by the bar pattern on the strip, it is difficult to accommodate changes in correction factors and dot densities. Critical mounting tolerances necessitate precision mechanical alignment during assembly. A shielding requirement also arises as optical encoders are sensitive to contamination by dirt and dust common to printers.

A further technique such as described by U.S. Pat. No. 4,305,674, Velazquaz, "Position Control Means for Data Printer Heads", issued Dec. 15, 1981, utilizes a rotary encoder coupled to the output shaft of a motor. The rotary motion of the motor is converted to a linear translation to drive a print bar through some type of cam or linkage assembly. The printer of this patent utilizes an optical rotary encoder, in conjunction with a light source and detector to produce a signal train from which the position of the printing head can be determined. Since the motor shaft position is related to the print head position by some nonlinear function, the shaft position relationship to printhead position must be mapped. Rotary encoder systems generally require critical mechanical adjustment of the mechanical linkage and/or phasing of the encoder. To prevent deterioration of the print quality periodic readjustment is necessary to compensate for wear of the mechanical linkage. Also, since the output pulse pattern is fixed by the rotary encoder bar pattern, it is difficult to accommodate changes in correction factors and dot densities.

SUMMARY OF THE INVENTION

In accordance with one embodiment of the present invention, a dot matrix impact printer controlled by a host processor comprises a main mechanism supporting a movable print bar and a print paper stepping system which consists of a stepper motor and paper drive tractors. Individual print hammers are mounted in a hammer bank on the print bar which is driven in a horizontal reciprocal motion by a motor through a cam arrangement. A linear capacitive encoder includes a pickup plate comprising several conductng plates disposed on the surface of a suitable material to form one plate of a capacitor rigidly attached to the moving print bar and a plurality of finger-like conducting plates arranged in a transmitter pattern on a printed circuit board to form the other plate of a capacitor which is mounted on the printer chassis. The transmitter pattern is driven by a 43 KHz polyphase square wave derived from an 11 MHz clock. The pickup plate is capacitively coupled to the transmitter pattern and picks up an analog signal, the phase of which represents the position of the print bar with respect to the printer chassis, and, by comparing the phase of the coupled signal to a reference signal, electrical signals or strobes representing incremental movements of the print bar are produced.

The linear capacitive encoder of the present invention provides several advantages over the prior art. This encoder does not require critical mounting tolerances.

The pickup plate can be positioned ±0.125" along the axis of lateral motion of the print bar, ±0.050" vertically (perpendicular to the axis of motion and parallel to the plane of the pickup plate), and the gap between the pickup plate and the transmitter pattern on the encoder printed circuit board is 0.015"±0.010". No gain or scaling adjustments are necessary since the accuracy of the output signal is a function of the accuracy of the placement of the transmitter or finger pattern on the encoder printed circuit board. Present day printed circuit board processing techniques produce a finger pattern repeatability of ±0.001" which provides a print bar position resolution of 0.001".

The encoder circuitry is divided into an analog section and a digital section. The output of the analog section includes four signals indicative of the states of four flip-flops repesenting the least two significant bits of the print bar position measured in 0.001" increments sampled every 23.3 microseconds. Two of the signals represent the present position of the print bar and the remaining two signals represent the position during the previous cycle.

The present position bits are compared with the previous position bits to produce electrical signals or strobes representing 0.001" incremental movements of the print bar, a pulse to represent direction reverse or turnaround of the print bar and a signal representing the direction of motion of the print bar. The direction signal indicates the direction the print bar is presently moving or last moved when the print bar is stopped and is a logic "1" when the print bar is moving from left to right when viewed from the front of the printer and a logic "0" when the print bar is moving from right to left. The 0.001" strobe goes to an event counter in a processor, and the direction turnaround pulse is used as an interrupt to notify the processor when the print bar has changed direction.

The encoder processor has the capability to map the basic resolution of the encoder analog circuitry (0.001") into a plurality of print positions with a resolution of 0.001". The processor outputs print position signals or strobes to the printer host processor and print hammer firing circuitry at a preselected dot density taking into account the print hammer flight times and compensating for the nonlinear motion of the print bar. The processor provides an autocalibrating function which eliminates the requirement for adjustments due to variations between printers or to wear of the mechanism. The encoder processor also allows correction factors to be included in the timing signal. The correction factors are programmed during manufacture and, when necessary, are adjustable by the operator from the printer front panel to optimize print quality.

DESCRIPTION OF THE PREFERRED EMBODIMENT

Figure 1:
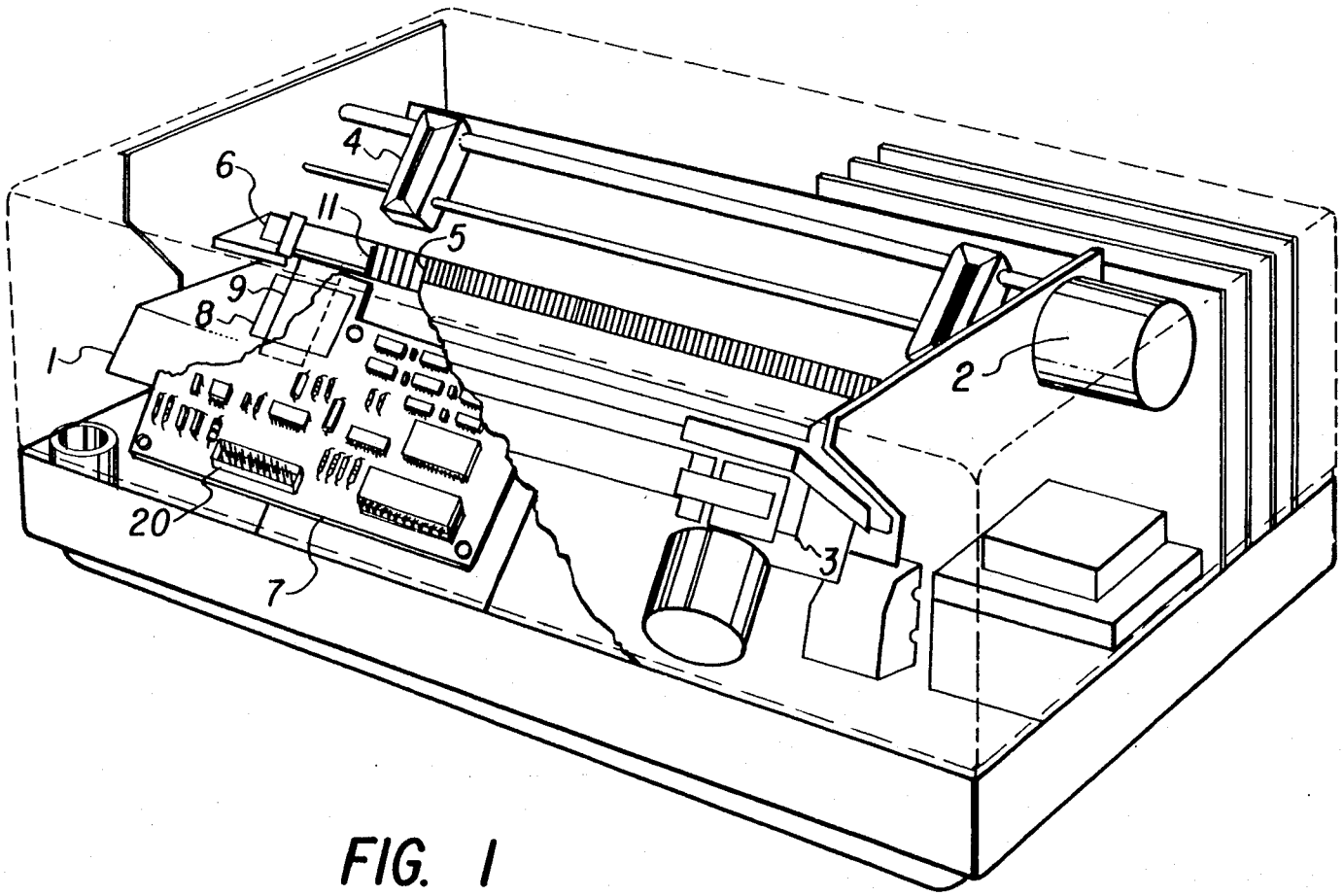
FIG. 1 is a cutaway view in perspective of a dot matrix impact printer employing a print bar position encoder in accordance with the preferred embodiment of the invention.
Figure 2:
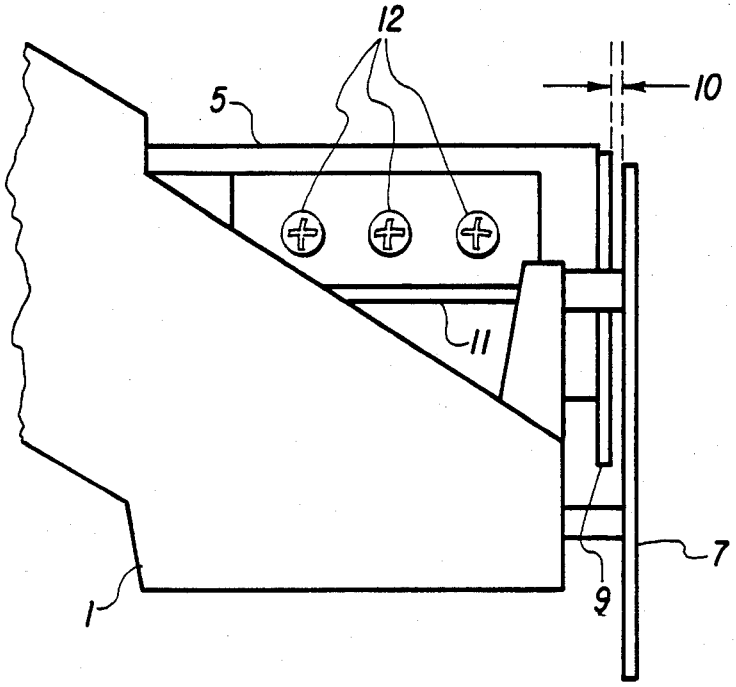
FIG. 2 is a side view of the left end of the printer shown in FIG. 1 illustrating the mounting and positioning of the encoder pickup plate and printed circuit board.

The preferred embodiment of the present invention is described in conjunction with a dot matrix impact printer as illustrated in FIG. 1. The invention is not limited to the particular printer shown, but it will be understood by those skilled in the art that the invention can be utilized in any application where it is desired to accurately determine the position of a movable member.

Referring to FIG. 1, the printer is comprised of a chassis 1 supporting a print bar 5 and a print paper stepping system generally comprised of a stepper motor 2 driving the tractors 4. The tractors pull edge-perforated paper (not shown) past the hammer bank (not shown) mounted on the print bar 5. The print paper is stepped one row at a time along a path between the hammer bank and a platen 6. A printing ribbon (not shown) may be disposed between the print paper and the print bar. By actuating a hammer at an appropriate time, the hammer face is propelled against the print ribbon forcing the ribbon against the paper and the platen 6 thereby printing a dot on the paper in the proper position. The ribbon motor assembly 3 draws the ribbon past the printing station defined by the hammer faces and the platen 6 to provide an adequate ink supply for printing and to facilitate even wear of the ribbon.

Now, referring to FIGS. 1, 2, 3A and 3B, the print bar 5 is moved reciprocally in a path parallel to the platen 6 and transverse to the path of paper flow thereby allowing the individual hammers to print in a plurality of dot columns. The print bar position encoder pickup plate 9 is attached to a bracket 11 which is mounted on the end of the moving print bar 5 such that it is positioned over the encoder transmitter pattern 8, and the plane of the pickup plate 9 is parallel to the plane of the transmitter pattern 8. The encoder transmitter pattern 8 comprises of eight sets 13 of five flat electrodes or fingers each on the circuit side of the stationary encoder printed circuit board 7 which is rigidly mounted on the chassis 1. The encoder bracket adjustment screws 12 attach the encoder bracket 11 to the print bar 5 and allow adjustment of the gap 10 between the pickup plate 9 and the encoder transmitter pattern 8.

Figure 4:
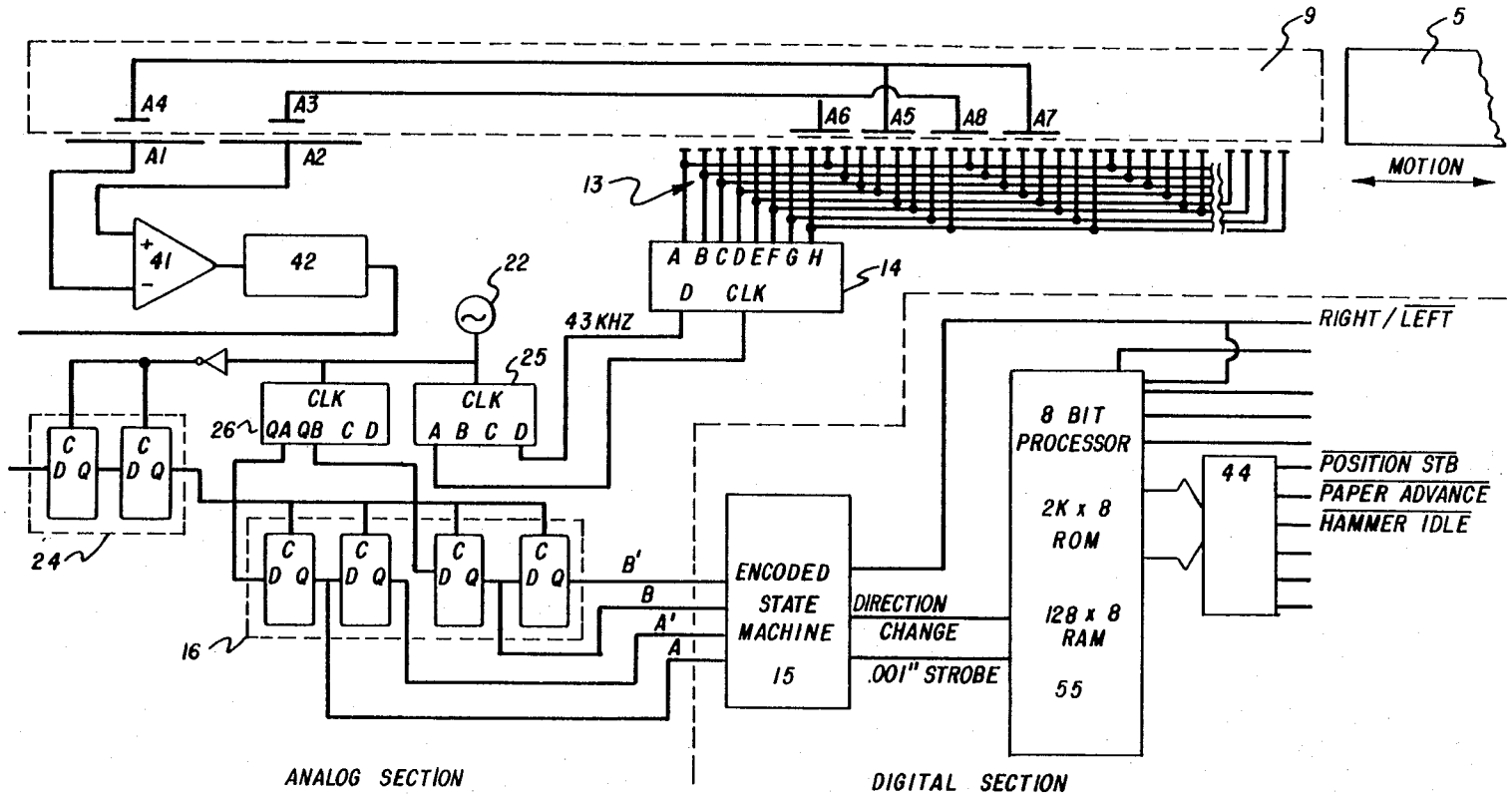
FIG. 4 is a block diagram of the encoder circuit.

Referring now to the analog section 70 of FIG. 4, the analog section of the encoder detects and amplifies the phase shift in the capacitive encoder output signal which represents the position of the print bar 5 with respect to the chassis 1 (FIG. 1). It outputs signals (A, A', B, B') representing the least two significant bits of the print bar 5 position measured in 0.001" increments. The position is sampled every 23.3 microseconds. A and B represent the present position A' and B' represent the position during the preceding 23.3 microsecond cycle.

Counters 25 and 26 and shift register 14 generate a 43 KHz eight-phase signal which effectively translates down the transmitter pattern fingers 13. A portion of this signal is coupled to the pickup plate 9 and, as the print bar 5 moves, the geometry of the capacitor plates changes and consequently the phase of the coupled 43 KHz signal changes with respect to the phase of the 43 KHz signal driving the transmitter pattern fingers 13.

Amplifier 41 and phase locked loop 42 amplify and filter the signal from the pickup plate 9. The output signal of the phase locked loop 42 is a TTL level. Dual flip-flops 24 then synchronize this signal with timing signals generated by the 11 MHz clock 22. The synchronized signal is utilized to lock or latch the QA and QB outputs of counter 26 into two two-bit shift registers comprising latch 16. The value latched represents the phase of the signal and thus the position of the print bar 5.

Figure 8:
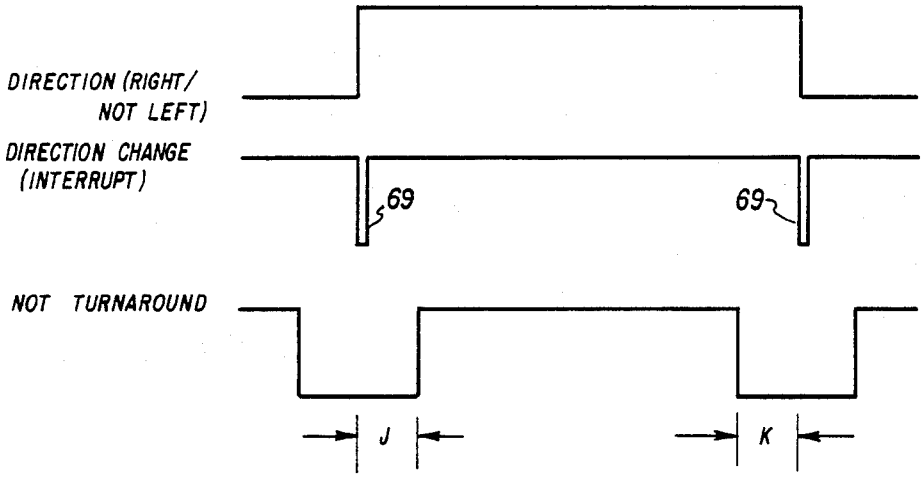
FIG. 8 is a timing diagram illustrating the timing relationship between the DIRECTION, DIRECTION CHANGE and NOT TURN AROUND signals.

Referring now to the digital section 75 of FIG. 4, the encoder state machine 15 has three outputs representing the 0.001" strobe, direction and direction change. The 0.001" strobe is a positive pulse which occurs each time the print bar moves 0.001" in either direction and goes to the event counter input of the processor 55. The direction output represents the present direction that the print bar is moving or last moved if the print bar is stopped. The direction output (as shown in FIG. 8) is a logic "1" if when viewed from the front of the printer the print bar is moving from left to right and a logic "0" when the print bar is moving from right to left. The direction change output (as shown in FIG. 8) is a negative pulse 69 which occurs whenever the direction of motion of the print bar changes. The direction change output functions as an interrupt to the processor 55 to notify it that the print bar has changed directions.

The processor 55 translates the "0.001" resolution of the print bar position to whatever resolution (i.e., dot density) is desired and outputs to the printer host processor and print hammer firing circuitry print position signals or strobes at the selected dot density taking into account print hammer flight times and compensating for the sinusoidal motion of the print bar. The processor 55 also provides various additional reference signals to the host processor. An output buffer 44 utilizes an octal latch (An octal latch manufactured by Texas Instruments designated LS374 may be used for this purpose.) to drive the output through a 20 pin connector 20 (FIG. 1).

Figure 5:
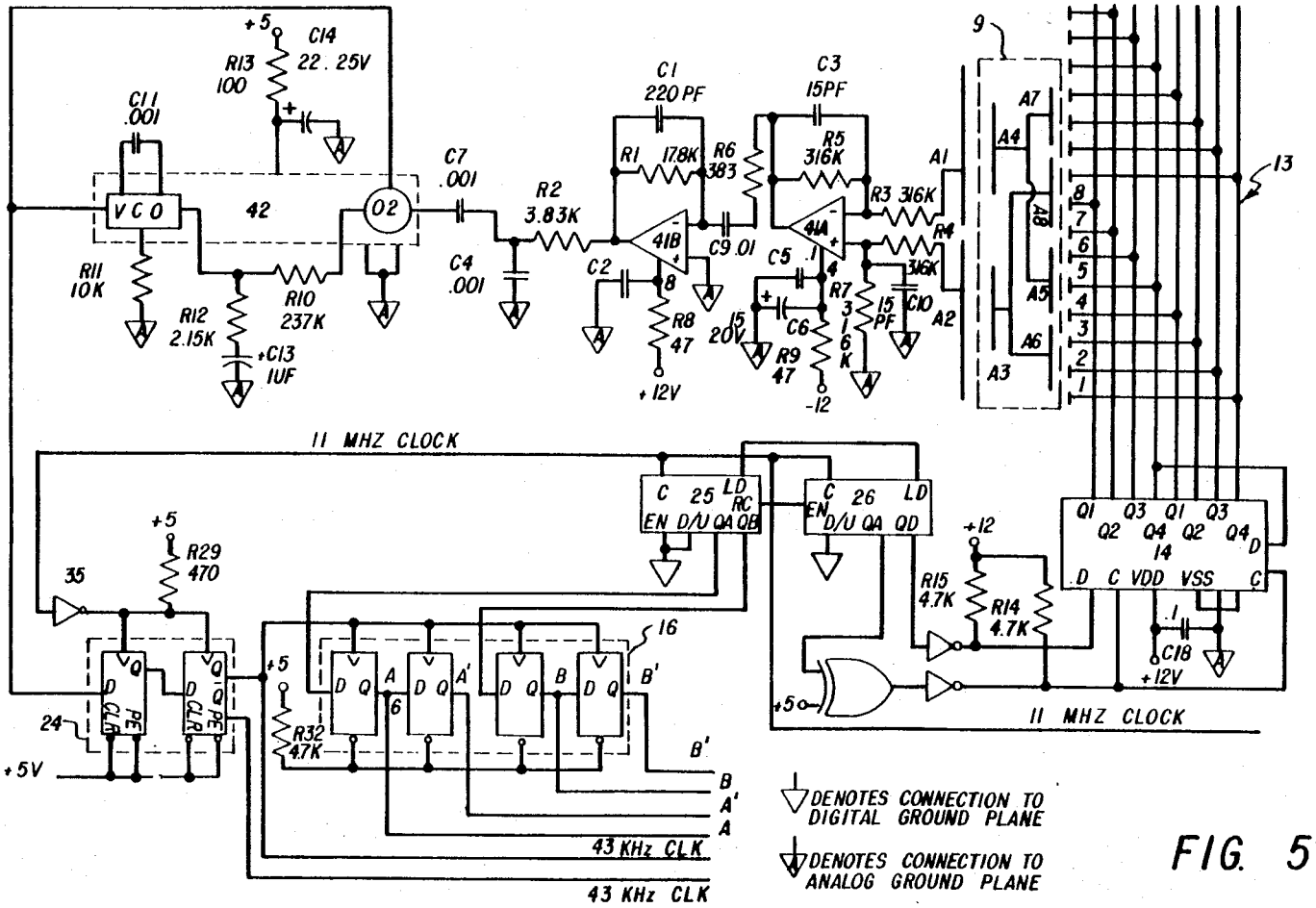
FIG. 5 is a schematic diagram of the analog section of the encoder circuitry.

The operation of the analog section 70 of the encoder will now be described with reference to FIGS. 3A, 3B, 5 and 9. The transmitter printed circuit pattern 8 (FIG. 3B) consists of eight sets 13 of five conducting electrodes or fingers each on the circuit side of the encoder printed circuit board 7 (FIG. 1). Each of these fingers is spaced on 0.032" centers such that each pattern of eight fingers spans 0.256". Each finger is connected to the corresponding fingers on each of the other seven patterns of five fingers. The resulting eight signal lines L1–L8 shown in FIG. 5 are driven by an eight-phase set of square waves Q1–Q4 and Q1'–Q4' shown in FIG. 9 with a frequency of 43 KHz derived from the 11 MHz clock 22 (FIG. 4) through the counters 26 and 25 and a CMOS dual four-bit static shift register 14 (A shift register manufactured by Motorola designated MC14015B may be utilized for this purpose.) The 11 MHz clock may be a crystal oscillator (A crystal oscillator manufactured by Motorola designated K1100A may be utilized for this purpose.), and the counters 26 and 25 may be four-bit binary counters (A binary counter manufactured by Texas Instruments designated LS191 may be utilized for this purpose.).

Figure 3B:
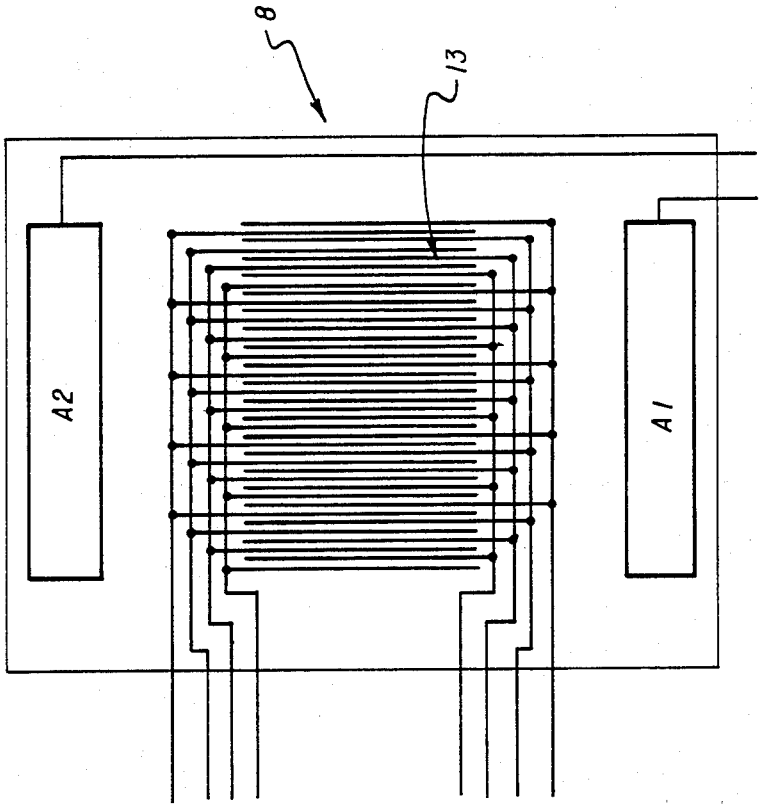
FIG. 3B is a plan view of the encoder transmitter pattern printed circuit board.
Figure 3A:
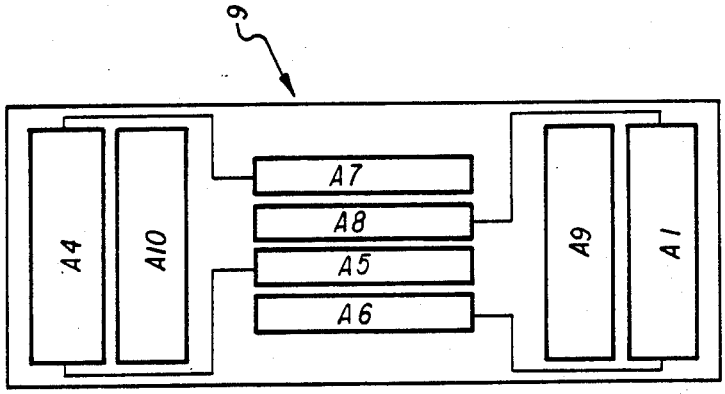
FIG. 3A is a plan view of the encoder pickup plate printed circuit board.
Figure 9:
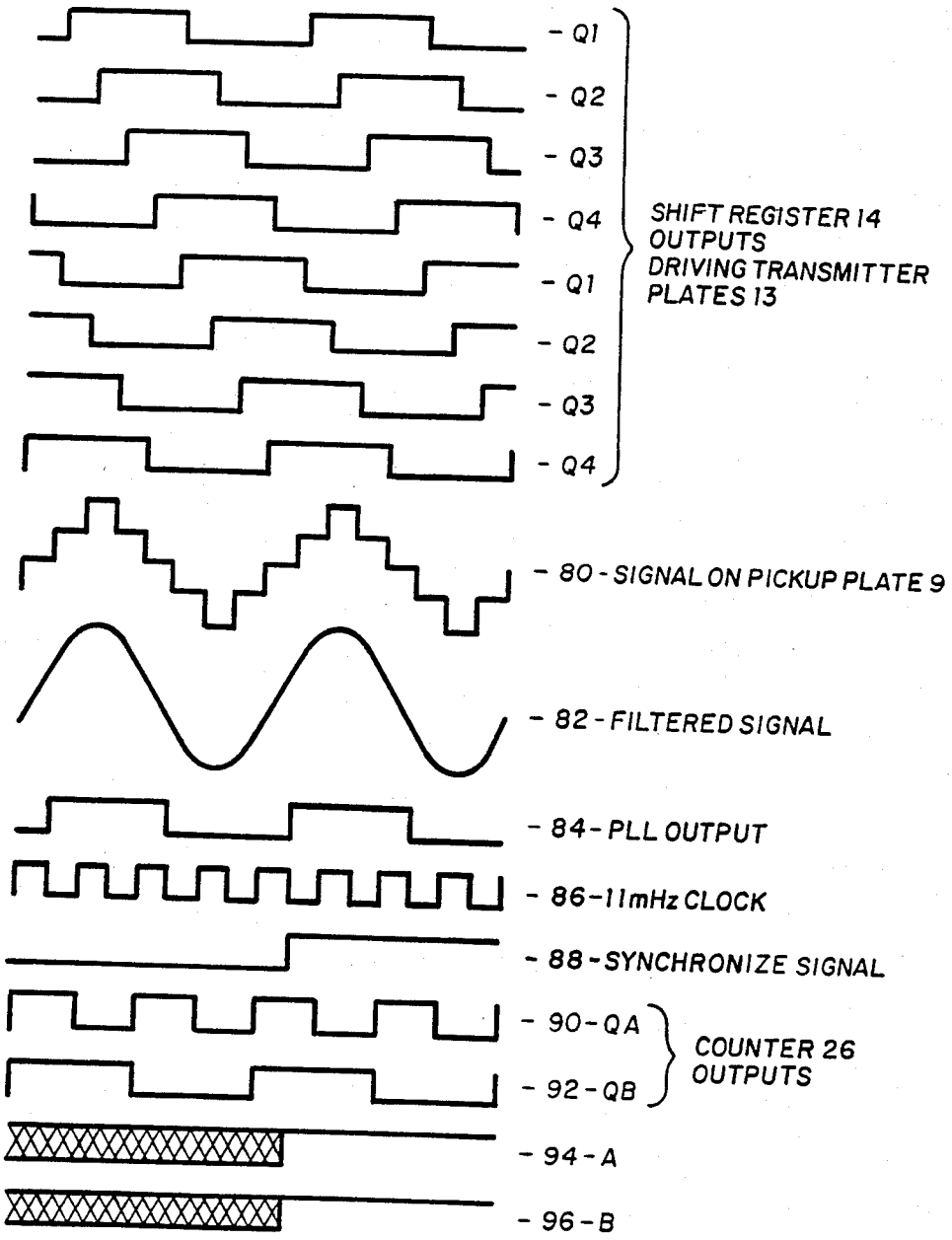
FIG. 9 is a timing diagram illustrating the timing relationships between the signals processed in the analog section of the encoder circuitry.

The pickup plate 9 is mounted on the moving print bar 5 such that it is positioned over the transmitter pattern 8 shown in FIG. 3B. On the pickup plate 9 are four conducting plates, A5, A6, A7 and A8, each of which is 0.128" wide. The four plates are adjacent to each other as shown in FIG. 3A and span a total of 0.512". The pickup plates A6 and A8 are coupled to the noninverting input of an amplifier 41A through the capacitor formed by plates A2 and A3. Pickup plates A5 and A7 are coupled to the inverting input of amplifier 41A through the capacitor formed by plates A1 and A4. Plates A9 and A10 (FIG. 3A) are connected to ground and function to shield plates A3 and A4 from any capacitively coupled signals from the finger pattern 13. Each pickup plate, A5, A6, A7 and A8, covers four transmitter fingers 13 which comprise four signal lines (as shown in FIG. 5) and is capacitively coupled to them. The signal on each pickup plate is a summation of the square waves on the transmitter fingers which are capacitively coupled to it. A stepped triangle wave 80 as shown in FIG. 9 results. Since they cover corresponding areas of adjacent transmitter fingers, the signals coupled to plates A6 and A8 are the same. Similarly, the signals coupled to plates A5 and A7 are the same and are 180 degrees out of phase with the signals coupled to plates A6 and A8. The phase of the fundamental of the stepped waveform 80 varies linearly with the position of the pickup plate 9 over the transmitter pattern 8 (FIG. 1). As the pickup plate 9 moves 0.256", the phase changes by 360 degrees. Due to even harmonics an apparent phase error will occur at the zero crossing. In the stepped waveform 80, the second harmonic level is about 25 db down from the fundamental.

The amplifiers 41A and 41B (An amplifier manufactured by National Semiconductor designated LF353 may be utilized for this purpose.) amplify and filter the stepped waveform 80 and provide an additional 20 db attenuation of the second harmonic of the 43 KHz signal.

The phase locked loop (PLL) 42 (A phase locked loop manufactured by Motorola designated MC14046B may be utilized for this purpose.) has internal amplifier and bias circuits which amplify and limit the filtered 43 KHz signal 82. The actual PLL then functions as a tracking bandpass filter to reduce the noise bandwidth of the analog signal path. The signal 82 at the input of the PLL 42 can be thought of as an FM modulated waveform with a 43 KHz carrier frequency, a modulation frequency of 18 Hz (the print bar shuttle frequency) with a deviation of approximately 100 Hz (this can be thought of as a doppler shift). The actual encoder position information is represented by the 18 Hz modulation.

D-Type flip-flops 24 (D-Type flip-flops manufactured by Texas Instruments designated ALS74 may be utilized for this purpose.) synchronize the signal 84 from the PLL 42 with the negative edge of the 11 MHz clock reference signal 86. The synchronized signal 88 is then used to latch the QA 90 and QB 92 outputs of the counter 26 onto the register 16. Since the square waves Q1–Q4 and Q1'–Q4' driving the transmitter pattern fingers 13 are also derived from counter 26, A 94, the latched output of QA, changes state everytime the phase of the fundamental component changes 1/256 cycle. Thus A 94 changes state once for every 0.001"

motion of the pickup plate 9. B 96, the latched output of QB, changes state every 1/128 cycle, or 0.002" motion of the pickup plate 9. The remaining two latches in register 16 store the previous 0.001" and 0.002" positions, A' and B' respectively. The four outputs of the register 16, A, A', B, B', go to the encoder state machine 15 (FIG. 4).

Figure 6:
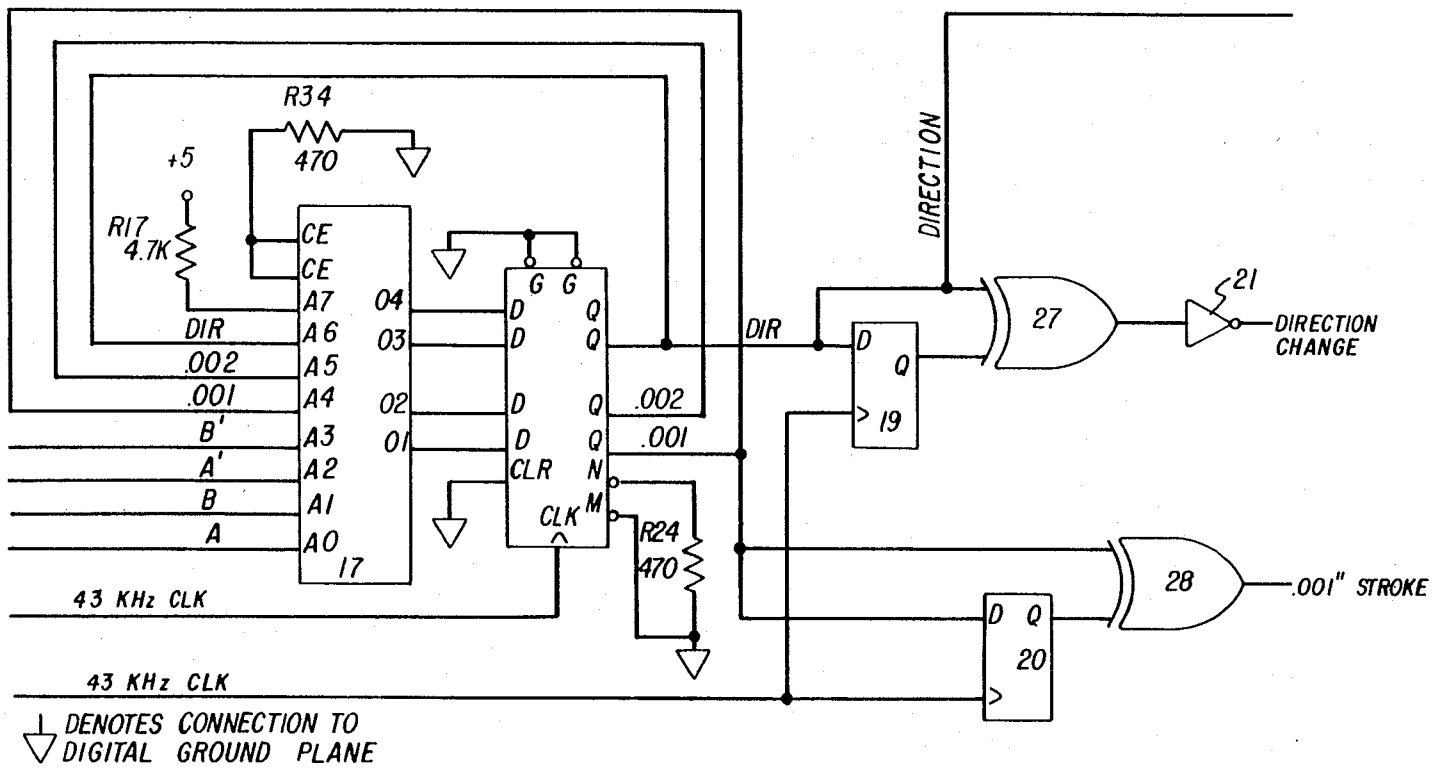
FIG. 6 is a schematic diagram of the encoder state machine.

Referring now to FIG. 6, the encoder state machine 15 includes a 256×4 bipolar PROM 17, a four-bit D-type register 18 (A four-bit register manufactured by Texas Instrument designated as LS173 may be utilized for this purpose.), two D-type flip-flops 19 and 20, two exclusive OR gates 27 and 28 (An OR gate manufactured by Texas Instruments designated as LS86 may be utilized for this purpose.) and an invertor 21 coupled to the output of the exclusive OR gate 27.

The function of the encoder state machine includes processing the inputs A, A', B, B' from the register 16 in the analog section (FIG. 5) to provide three output signals representing a 0.001" movement of the print bar, the direction of motion of the print bar, and a change in direction of motion of the print bar. Digital error or hysteresis is introduced to the direction and direction output signal to prevent false direction changes and false position strobes due to phase noise on the 43 KHz signal in the analog section through the phase locked loop.

When the print bar motion is one direction or the other, ideally the BA inputs would be 00 01 10 11 00 . . . when counting up or the opposite 00 11 10 01 00 . . . when counting down. The counts change at a maximum rate which corresponds to a peak print bar velocity of 25 inches per second or 25,000 milli inches per second or 40 microseconds between changes. To allow for a greater print bar shuttle frequency and because no input changes can be missed, the sample frequency, derived from the 11 MHz clock 22 (as shown in FIG. 4), is 42.9 KHz or 23.3 microseconds between pulses.

The four inputs to the encoder state machine are B',A',B,A. Noise may cause the outputs of the counter 26 (FIG. 5) to generate erroneous states. Of the 16 possible combinations of the 4 inputs, 9 are valid in normal operation and 7 are not and are considered to be fault states. The 9 valid combinations and the actions taken by the state machine are shown in Table 1.

TABLE 1

| Previous Input | Current Input | Action Taken |
|---|---|---|
| 1. current state | current state | none-keep same direction, no strobe |
| 2. current state | current state−1 | none-keep same direction, no strobe |
| 3. current state−1 | current state | none-keep same direction, no strobe |
| 4. current state−1 | current state−1 | none-keep same direction, no strobe |
| 5. current state | current state+1 | keep same direction, cause a strobe and go to current state+1 |
| 6. current state | current state+2 | keep same direction, cause a strobe, go to current state+1(*double jump*) |
| 7. current state+1 | current state+1 | caused by double jump-keep same dir., cause a strobe, go to current state+1 |
| 8. current state+1 | current state+2 | caused by double jump-keep same dir., cause a strobe, go to current state+1 |
| 9. current state−1 | current state−2 | cause a direction change, no strobe, go to current state−2. (note** current state−2 is the same as current state+2) |

When counts are occurring in the direction of motion of the print bar and each count is only one count away from the previous count, the encoder state machine outputs a 0.001" strobe to the processor 55 (FIG. 4). However, when the counts in a sequence represent a change in direction it could be the result of noise, and the state machine takes no action but remembers the apparent direction change and looks at the next input sample to make the decision. As long as the B A inputs do not move more than one count away from the previous count because of noise, the state machine will operate properly. The special case of a double jump in the direction of motion is allowed for. Assuming the possibility of missing the sample of present input count of plus one at high print bar slew rates, the present count may be two more than the previous count because of noise. In this case the state machine will output a 0.001" strobe without any errors. A basic premise to be able to make this assumption is that direction changes can occur only with the velocity going through zero, so print bar slew rate will not be a problem and exact count sequences are required for the direction change output.

A sample output count sequence and the required state machine outputs are shown below: (assume direction was going right and stable at BA=00).

| | | | | | | | | | | | | | | | | | | | | |
|---|---|---|---|---|---|---|---|---|---|---|---|---|---|---|---|---|---|---|---|---|
| Input (BA) | 00 | 00 | 01 | 10 | 11 | 00 | 11 | 11 | 00 | 01 | 10 | 11 | 00 | 11 | 10 | 01 | 00 | 11 | 00 . . . |
| Direction | R | R | R | R | R | R | R | R | R | R | R | R | R | R | L | L | L | L | L . . . |
| Strobe | 0 | 0 | 1 | 1 | 1 | 1 | 0 | 0 | 0 | 1 | 1 | 1 | 1 | 0 | 0 | 1 | 1 | 1 | 1 . . . |

The processor 55 (FIG. 4) is a single chip eight-bit microprocessor (An eight-bit microprocessor manufactured by Intel designated as 8049H may be utilized for this purpose.). It uses 2K×8 of program memory and 128×8 of data memory (RAM) internal to the chip. Firmware occupies most of the 2K×8 program memory space. Five of the eight 256 byte pages contain executable program code while the remaining three 256 byte pages contain six dot density tables which are used to look up the next position strobe and the present output at each event counter interrupt. The processor outputs position strobes to the host printer to fire the print hammers at the appropriate time to correctly place the dots. It also outputs other miscellaneous signals and communicates with the host processor over a serial port.

Figure 7:
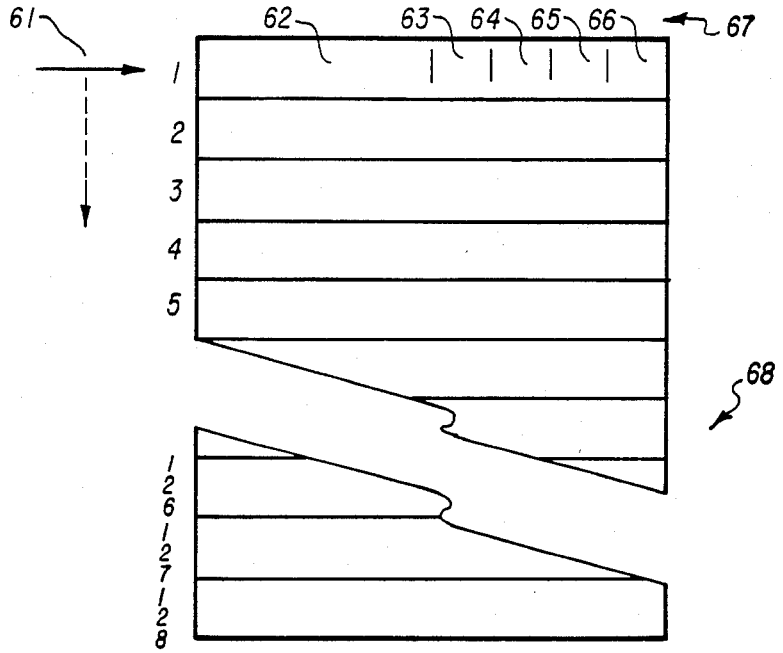
FIG. 7 is a diagram illustrating the arrangement of data in a processor output table.

The basic operation of the processor is as follows: The encoder state machine outputs a 0.001" strobe or a series of such strobes, each strobe representing a movement of 0.001" in a given direction of motion of the print bar. Referring now to FIG. 7, on a given strobe, the processor will be interrupted and perform the following steps:

1. save the environment;
2. look up the next byte 67 in the processor output table 68;

3. strip the leftmost four bits 62 from the byte 67 and update a processor event counter with a value which allows the next n-1 0.001" strobes to be ignored;
4. output the rightmost four bits 63, 64, 65, 66 of the table 68;
5. restore the environment; and
6. return to the point of interrupt.

The spacing of the position strobes output by the processor is determined by the leftmost four bits 62, and a function of the dot density utilized by the printer. For example, at a dot density of 210 dots per inch, a position strobe is required every 0.00476" of print bar movement. The interrupts occur each 0.001" so several (n-1) intervening interrupts require no processor action and may be ignored.

When the print bar changes direction, the encoder state machine will output an interrupt to the processor of a higher priority than the 0.001" strobe interrupt. Referring to FIG. 7, upon receiving a direction change interrupt, the processor will:

1. save the environment;
2. reset the output table pointer 61 to the beginning of the processor output table 68;
3. complete the auto-centering algorithm;
4. restore the environment; and
5. return to the point of interrupt.

All of the intelligence associated with the processor in terms of generating correct position strobes is contained in the processor output table 68. This table is based on a model of print bar motion as X=Xmax sin (wt) and is generated by a FORTRAN program. The program's output is a table 128 bytes long, called ROM2, containing the information the processor requires to output position strobes at the selected dot density compensating for print hammer flight times and the sinusoidal motion of the print bar. Table 2 is an example of ROM2 corresponding to a dot density of 210 dots per inch.

TABLE 2

ROM2 MAP WITH DOT DENSITY= 210 DOTS/INCH
XMAX(INCHES)=.22795 FMOG(HZ) = 17.7333
FLIGHT TIME(SEC)= 380.0E-06

| I | LOOKAHEAD | | | | TA | HI | PA | ST |
|---|---|---|---|---|---|---|---|---|
| I= 1 | 1 | 1 | 1 | 1 | 0 | 1 | 0 | 1 |
| I= 2 | 1 | 0 | 1 | 1 | 0 | 1 | 0 | 0 |
| I= 3 | 0 | 0 | 1 | 0 | 0 | 0 | 0 | 0 |
| I= 4 | 0 | 0 | 1 | 0 | 1 | 0 | 1 | 1 |
| I= 5 | 0 | 1 | 0 | 0 | 1 | 0 | 1 | 0 |
| I= 6 | 0 | 1 | 0 | 1 | 1 | 0 | 1 | 0 |
| I= 7 | 0 | 1 | 0 | 0 | 1 | 0 | 1 | 0 |
| I= 8 | 0 | 1 | 0 | 1 | 1 | 0 | 1 | 0 |
| I= 9 | 0 | 1 | 0 | 0 | 1 | 0 | 1 | 0 |
| I= 10 | 0 | 1 | 0 | 1 | 1 | 0 | 1 | 0 |
| I= 11 | 0 | 1 | 0 | 1 | 1 | 0 | 1 | 0 |
| I= 12 | 0 | 1 | 0 | 0 | 1 | 0 | 1 | 0 |
| I= 13 | 0 | 1 | 0 | 1 | 1 | 0 | 1 | 0 |
| I= 14 | 0 | 1 | 0 | 0 | 1 | 0 | 1 | 0 |
| I= 15 | 0 | 1 | 0 | 1 | 1 | 0 | 1 | 0 |
| I= 16 | 0 | 1 | 0 | 1 | 1 | 0 | 1 | 0 |
| I= 17 | 0 | 1 | 0 | 0 | 1 | 0 | 1 | 0 |
| I= 18 | 0 | 1 | 0 | 1 | 1 | 0 | 1 | 0 |
| I= 19 | 0 | 1 | 0 | 0 | 1 | 0 | 1 | 0 |
| I= 20 | 0 | 1 | 0 | 1 | 1 | 0 | 1 | 0 |
| I= 21 | 0 | 1 | 0 | 1 | 1 | 0 | 1 | 0 |
| I= 22 | 0 | 1 | 0 | 0 | 1 | 0 | 1 | 0 |
| I= 23 | 0 | 1 | 0 | 1 | 1 | 0 | 1 | 0 |
| I= 24 | 0 | 1 | 0 | 1 | 1 | 0 | 1 | 0 |
| I= 25 | 0 | 1 | 0 | 0 | 1 | 0 | 1 | 0 |
| I= 26 | 0 | 1 | 0 | 1 | 1 | 0 | 1 | 0 |
| I= 27 | 0 | 1 | 0 | 1 | 1 | 0 | 1 | 0 |
| I= 28 | 0 | 1 | 0 | 0 | 1 | 0 | 1 | 0 |
| I= 29 | 0 | 1 | 0 | 1 | 1 | 0 | 1 | 0 |

TABLE 2-continued

ROM2 MAP WITH DOT DENSITY= 210 DOTS/INCH
XMAX(INCHES)=.22795 FMOG(HZ) = 17.7333
FLIGHT TIME(SEC)= 380.0E-06

| I | LOOKAHEAD | | | | TA | HI | PA | ST |
|---|---|---|---|---|---|---|---|---|
| I= 30 | 0 | 1 | 0 | 1 | 1 | 0 | 1 | 0 |
| I= 31 | 0 | 1 | 0 | 0 | 1 | 0 | 1 | 0 |
| I= 32 | 0 | 1 | 0 | 1 | 1 | 0 | 1 | 0 |
| I= 33 | 0 | 1 | 0 | 1 | 1 | 0 | 1 | 0 |
| I= 34 | 0 | 1 | 0 | 1 | 1 | 0 | 1 | 0 |
| I= 35 | 0 | 1 | 0 | 0 | 1 | 0 | 1 | 0 |
| I= 36 | 0 | 1 | 0 | 1 | 1 | 0 | 1 | 0 |
| I= 37 | 0 | 1 | 0 | 1 | 1 | 0 | 1 | 0 |
| I= 38 | 0 | 1 | 0 | 0 | 1 | 0 | 1 | 0 |
| I= 39 | 0 | 1 | 0 | 1 | 1 | 0 | 1 | 0 |
| I= 40 | 0 | 1 | 0 | 1 | 1 | 0 | 1 | 0 |
| I= 41 | 0 | 1 | 0 | 1 | 1 | 0 | 1 | 0 |
| I= 42 | 0 | 1 | 0 | 0 | 1 | 0 | 1 | 0 |
| I= 43 | 0 | 1 | 0 | 1 | 1 | 0 | 1 | 0 |
| I= 44 | 0 | 1 | 0 | 1 | 1 | 0 | 1 | 0 |
| I= 45 | 0 | 1 | 0 | 1 | 1 | 0 | 1 | 0 |
| I= 46 | 0 | 1 | 0 | 0 | 1 | 0 | 1 | 0 |
| I= 47 | 0 | 1 | 0 | 1 | 1 | 0 | 1 | 0 |
| I= 48 | 0 | 1 | 0 | 1 | 1 | 0 | 1 | 0 |
| I= 49 | 0 | 1 | 0 | 1 | 1 | 0 | 1 | 0 |
| I= 50 | 0 | 1 | 0 | 1 | 1 | 0 | 1 | 0 |
| I= 51 | 0 | 1 | 0 | 0 | 1 | 0 | 1 | 0 |
| I= 52 | 0 | 1 | 0 | 1 | 1 | 0 | 1 | 0 |
| I= 53 | 0 | 1 | 0 | 1 | 1 | 0 | 1 | 0 |
| I= 54 | 0 | 1 | 0 | 1 | 1 | 0 | 1 | 0 |
| I= 55 | 0 | 1 | 0 | 1 | 1 | 0 | 1 | 0 |
| I= 56 | 0 | 1 | 0 | 0 | 1 | 0 | 1 | 0 |
| I= 57 | 0 | 1 | 0 | 1 | 1 | 0 | 1 | 0 |
| I= 58 | 0 | 1 | 0 | 1 | 1 | 0 | 1 | 0 |
| I= 59 | 0 | 1 | 0 | 1 | 1 | 0 | 1 | 0 |
| I= 60 | 0 | 1 | 0 | 1 | 1 | 0 | 1 | 0 |
| I= 61 | 0 | 1 | 0 | 1 | 1 | 0 | 1 | 0 |
| I= 62 | 0 | 1 | 0 | 0 | 1 | 0 | 1 | 0 |
| I= 63 | 0 | 1 | 0 | 1 | 1 | 0 | 1 | 0 |
| I= 64 | 0 | 1 | 0 | 1 | 1 | 0 | 1 | 0 |
| I= 65 | 0 | 1 | 0 | 1 | 1 | 0 | 1 | 0 |
| I= 66 | 0 | 1 | 0 | 1 | 1 | 0 | 1 | 0 |
| I= 67 | 0 | 1 | 0 | 1 | 1 | 0 | 1 | 0 |
| I= 68 | 0 | 1 | 0 | 0 | 1 | 0 | 1 | 0 |
| I= 69 | 0 | 1 | 0 | 1 | 1 | 0 | 1 | 0 |
| I= 70 | 0 | 1 | 0 | 1 | 1 | 0 | 1 | 0 |
| I= 71 | 0 | 1 | 0 | 1 | 1 | 0 | 1 | 0 |
| I= 72 | 0 | 1 | 0 | 1 | 1 | 0 | 1 | 0 |
| I= 73 | 0 | 1 | 0 | 1 | 1 | 0 | 1 | 0 |
| I= 74 | 0 | 1 | 0 | 1 | 1 | 0 | 1 | 0 |
| I= 75 | 0 | 1 | 0 | 1 | 1 | 0 | 1 | 0 |
| I= 76 | 0 | 1 | 0 | 1 | 1 | 0 | 1 | 0 |
| I= 77 | 0 | 1 | 0 | 1 | 1 | 0 | 1 | 0 |
| I= 78 | 0 | 1 | 0 | 1 | 1 | 0 | 0 | 0 |
| I= 79 | 0 | 1 | 0 | 1 | 1 | 0 | 0 | 0 |
| I= 80 | 0 | 1 | 0 | 1 | 1 | 0 | 0 | 0 |
| I= 81 | 0 | 1 | 0 | 1 | 1 | 0 | 0 | 0 |
| I= 82 | 0 | 1 | 0 | 1 | 1 | 0 | 0 | 0 |
| I= 83 | 0 | 1 | 0 | 1 | 1 | 0 | 0 | 0 |
| I= 84 | 0 | 1 | 0 | 1 | 1 | 0 | 0 | 0 |
| I= 85 | 0 | 1 | 0 | 1 | 1 | 0 | 0 | 0 |
| I= 86 | 0 | 1 | 0 | 1 | 1 | 0 | 0 | 0 |
| I= 87 | 1 | 0 | 0 | 0 | 1 | 0 | 0 | 0 |
| I= 88 | 0 | 0 | 1 | 1 | 0 | 0 | 0 | 1 |
| I= 89 | 1 | 1 | 1 | 1 | 0 | 1 | 0 | 1 |
| I= 90 | 1 | 1 | 1 | 1 | 0 | 1 | 0 | 1 |
| I= 91 | 1 | 1 | 1 | 1 | 0 | 1 | 0 | 1 |
| I= 92 | 1 | 1 | 1 | 1 | 0 | 1 | 0 | 1 |
| I= 93 | 1 | 1 | 1 | 1 | 0 | 1 | 0 | 1 |
| I= 94 | 1 | 1 | 1 | 1 | 0 | 0 | 0 | 1 |
| I= 95 | 1 | 1 | 1 | 1 | 0 | 0 | 0 | 1 |
| I= 96 | 1 | 1 | 1 | 1 | 0 | 0 | 0 | 1 |
| I= 97 | 1 | 1 | 1 | 1 | 0 | 0 | 0 | 1 |
| I= 98 | 1 | 1 | 1 | 1 | 0 | 0 | 0 | 1 |
| I= 99 | 1 | 1 | 1 | 1 | 0 | 0 | 0 | 1 |
| I= 100 | 1 | 1 | 1 | 1 | 0 | 0 | 0 | 1 |
| I= 101 | 1 | 1 | 1 | 1 | 0 | 0 | 0 | 1 |
| I= 102 | 1 | 1 | 1 | 1 | 0 | 0 | 0 | 1 |
| I= 103 | 1 | 1 | 1 | 1 | 0 | 0 | 0 | 1 |
| I= 104 | 1 | 1 | 1 | 1 | 0 | 0 | 0 | 1 |
| I= 105 | 1 | 1 | 1 | 1 | 0 | 0 | 0 | 1 |
| I= 106 | 1 | 1 | 1 | 1 | 0 | 0 | 0 | 1 |
| I= 107 | 1 | 1 | 1 | 1 | 0 | 0 | 0 | 1 |

TABLE 2-continued

ROM2 MAP WITH DOT DENSITY= 210 DOTS/INCH
XMAX(INCHES)=.22795 FMOG(HZ) = 17.7333
FLIGHT TIME(SEC)= 380.0E-06

| I | LOOKAHEAD | | | | TA | HI | PA | ST |
|---|---|---|---|---|---|---|---|---|
| I= 108 | 1 | 1 | 1 | 1 | 0 | 0 | 0 | 1 |
| I= 109 | 1 | 1 | 1 | 1 | 0 | 0 | 0 | 1 |
| I= 110 | 1 | 1 | 1 | 1 | 0 | 0 | 0 | 1 |
| I= 111 | 1 | 1 | 1 | 1 | 0 | 0 | 0 | 1 |
| I= 112 | 1 | 1 | 1 | 1 | 0 | 0 | 0 | 1 |
| I= 113 | 1 | 1 | 1 | 1 | 0 | 0 | 0 | 1 |
| I= 114 | 1 | 1 | 1 | 1 | 0 | 0 | 0 | 1 |
| I= 115 | 1 | 1 | 1 | 1 | 0 | 0 | 0 | 1 |
| I= 116 | 1 | 1 | 1 | 1 | 0 | 0 | 0 | 1 |
| I= 117 | 1 | 1 | 1 | 1 | 0 | 0 | 0 | 1 |
| I= 118 | 1 | 1 | 1 | 1 | 0 | 0 | 0 | 1 |
| I= 119 | 1 | 1 | 1 | 1 | 0 | 0 | 0 | 1 |
| I= 120 | 1 | 1 | 1 | 1 | 0 | 0 | 0 | 1 |
| I= 121 | 1 | 1 | 1 | 1 | 0 | 0 | 0 | 1 |
| I= 122 | 1 | 1 | 1 | 1 | 0 | 0 | 0 | 1 |
| I= 123 | 1 | 1 | 1 | 1 | 0 | 0 | 0 | 1 |
| I= 124 | 1 | 1 | 1 | 1 | 0 | 0 | 0 | 1 |
| I= 125 | 1 | 1 | 1 | 1 | 0 | 0 | 0 | 1 |
| I= 126 | 1 | 1 | 1 | 1 | 0 | 0 | 0 | 1 |
| I= 127 | 1 | 1 | 1 | 1 | 0 | 0 | 0 | 1 |
| I= 128 | 1 | 1 | 1 | 1 | 0 | 0 | 0 | 1 |

The processor ROM contains six such output tables, each table corresponding to one of six dot densities. Two output tables occupy each of the last three 256 byte pages of the 2K×8 ROM.

Referring to FIG.7, each output table 68 is organized as follows: Lookahead 62, leftmost 4 bits; Turnaround 63, 1 bit; Paper Advance 64, 1 bit; Hammer Idle 65, 1 bit; and Position Strobe 66, rightmost bit. Each output table entry 67 is 1 byte and each Table 68 is 128 bytes long. At the direction change interrupt, the output table pointer 61, called OUTPTR, is set to point to the first entry location in the output table. As the printbar moves and builds in velocity, an event counter in the processor counts up for each 0.001" strobe received from the state machine 15 (FIG. 4). When the counter overflows, an event counter interrupt occurs and the processor does the following:

1. Saves its environment by switching banks of registers for maximum speed;
2. Retrieves the current byte 67 from the output table 68 pointed to by OUTPTR 61;
3. Strips the leftmost 4 bits from the byte, Lookahead 62, and places them in the event counter (this must be done in between potential 0.001" strobes so that no counts are lost. This is accomplished by the counter continuing to count during the interrupt routine and accounting for any counts which may have occurred by subtracting them from the actual number loaded into the event counter in between possible 0.001" counts so that no race conditions exist.);
4. Using the current byte 67 from the output table 68, outputs the rightmost 4 bits (Turnaround 62, Paper Advance 63, Hammer Idle 64, and Position Strobe 65) to output buffer 44 (FIG. 4);
5. Increment the output table pointer 61 (OUTPTR) to be ready for the next event counter interrupt;
6. Restore the environment by switching back to the main bank of registers; and
7. Return to the point of interrupt and continue whatever processing was being done at the point of interrupt.

When a direction change interrupt occurs, the output table pointer 61 (OUTPTR) is set to the beginning of the output table 68 in preparation for another pass of the print bar, and the processor makes a number of computations to check for parameters out of bounds. The processor has time right after a direction change interrupt because the print bar velocity has just gone through zero and the speed has not yet built up, therefore, considerable time is available between 0.001" strobes for computations. The most important of these computations being the auto-centering algorithm explained below.

Most of the processor code is conventional, the major exception being the auto-centering algorithm. The lateral motion of a specific print hammer on the print bar can be modeled as $$X = X\max \text{ SIN } (wt)$$

where X is the instantaneous position of the print hammer, Xmax is the peak lateral stroke of the print bar, w (omega) is the angular velocity (radians/seconds) of the print bar and t is time (seconds).

The equation for X is accurate to within 1-2% of the true lateral position. If Xmax were truly constant, the auto-centering algorithm would not be required. However, because of manufacturing tolerances and wear, the Xmax value can vary from printer or printer or even vary slightly in an individual printer.

The absolute reference point for X is established at each direction turnaround in the encoder. This eliminates the requirement for a third absolute reference point utilizing an optical interrupter such as used in some printers. When the encoder state machine outputs a direction change strobe, it interrupts the processor 55 (FIG. 4) which resets the pointer 61 to the beginning of a selected dot density table. It is significant that the processor itself does not require the direction of print bar movement, but treats each direction change as symmetrical. The processor receives a direction change interrupt at X=Xmax and X=−Xmax. If Xmax varies for any reason, a dot placement error results because the absolute position reference is the direction change. For example, if Xmax is too small, dots printed in the left-to-right direction will be misplaced to the right and dots printed in the right-to-left direction will be misplaced to the left, creating a "dot slalom" effect in vertical lines. Because the misplacement adds rather than cancels, a 0.001" change in Xmax will result in a 0.002" error from one dot row to the next.

Now referring to FIG. 8, to monitor changes in Xmax in real time and center the print on each pass the following variables are defined: NOT TURNAROUND—is a signal which is a logic 1 whenever X is in the range—0.200"≦X≦0.200" and a logic 0 otherwise. In other words, whenever the print elements are in the normal printing position of ±0.200" from X=0, the printbar is not in turnaround and NOT TURNAROUND=logic 1. When the print hammers are outside the printing range, the printbar is turning around and NOT TURNAROUND=logic 0. This signal is internal to the encoder and is not used in the rest of the printer.

DIRECTION CHANGE—a short negative pulse 69 which occurs whenever the direction of motion changes from right to left or vice versa and is used to interrupt the processor. It is used as a reference point.

J—a variable which represents the number of 0.001" strobes from DIRECTION CHANGE to NOT TURNAROUND going away (to a logic 1).

K—a variable which represents the number of 0.001" strobes from NOT TURNAROUND appearing (to a logic 0) to DIRECTION CHANGE.

DELTA J—a variable which is computed at each turnaround and then added to J to make the sum $J+\text{DELTA } J=K$.

The algorithm operates in the following manner. Referring to FIG. 8, when the printer is turned on, J is calculated initially by scanning the dot density table from the beginning entry to the entry where NOT TURNAROUND goes high. This gives a first guess J based on the nominal mechanism dimensions and tolerances. During operation, at the direction change interrupt, K is calculated by a backwards scan in the dot density table from the location at the interrupt back to the point where NOT TURNAROUND went low. The NOT TURNAROUND signal must be symmetrical about the DIRECTION CHANGE reference for the print to be centered in both directions. After K is calculated at the direction change interrupt, DELTA J is calculated as follows:

$$\text{DELTA } J=(K=J)/2$$

DELTA J is then added to the present value of J in order to force J=K and keep the print centered. As an example, suppose that K was 0.002" less than J on some given pass of the printbar. This would mean that the print was delayed in position because J was larger than K. DELTA J would be computed as (K−J)/2 or DELTA J=0.001". Then $J=J+\text{DELTA } J$ which would mean that J would be reduced by 0.001" on the next pass. This would advance the next pass print by 0.001" and serve to make J=K. If desired, smoothing algorithms could be applied to DELTA J before its addition to J, but in general it has been found to be adequate to correct J on a pass-by-pass basis all at once.

The encoder state machine has a 0.002" built-in error or hysteresis in the direction signal such that the direction change signal occurs 0.002" late in position from the true position of the print bar. Electronic delays may add another 0.001" in offset which results in a total offset on the order of 0.002" to 0.003" from true position. The processor 55 compensates for position offset by a variable called OFFSET which is programmed at 0.002" during manufacture and can be adjusted from the front panel of the printer when necessary. OFFSET is added to DELTA J after a number of initial checks are performed on DELTA J to ensure that it is not too large in either the positive or negative direction.

We claim:

1. Apparatus for determining the position, with respect to a reference point, of a movable member comprising:

means for producing a train of successive polyphase pulses and a train of successive reference pulses;

transmitting means for transmitting said polyphase pulse train;

receiving means capacitively coupled to said transmitting means for producing a signal from a summation of successive coupled pulses of said polyphase pulse train, said signal embodying information indicative of the position of said movable member with respect to said reference point;

detector means coupled to said receiving means providing a TTL signal, derived from said signal, representing the phase of said signal;

first means coupled to said detector means for comparing said TTL signal with said reference pulse train to provide a first signal representing a first incremental position change of said movable member and a second signal representing a second incremental position change of said movable member; and second means coupled to said first means for comparing said first incremental position with said second incremental position change and providing an output strobe representing an incremental position change of said movable member when said position changes are occurring in the direction of motion of said movable member and said first position change being one increment away from said second position change, and providing an output signal representing the direction of motion of said movable member, and providing a pulse representing a change of direction of the motion of said movable member whereby the position of said movable member with respect to said reference point may be determined.

2. The apparatus in claim 1 wherein said transmitter means comprises a plurality of electrically conducting transmitter plates, each of said transmitter plates comprising a plurality of conducting electrodes disposed in a plane; and said receiving means comprises a plurality of electrically conducting receiver plates disposed in a plane, each receiver plate capactively coupled to at least one transmitter plate.

3. The apparatus as in claim 2 wherein said polyphase pulse train comprises a plurality of pulses electrically separated in phase; and each transmitting plate of said plurality of transmitter plates transmitting one pulse of said plurality of pulses of said polyphase pulse train.

4. The apparatus as in claim 3 wherein said transmitting means is fixedly attached to said reference point; and said receiving means is disposed on said movable member orientated with respect to said transmitter means whereby the plane of said receiving means is parallel to both the plane of said transmitter means and the axis of motion of said movable member.

5. Apparatus as in claim 1 wherein the means for producing said train of successive polyphase pulses and said train of successive reference pulses comprises:

a crystal controlled oscillator; and a plurality of binary counters, coupled to said crystal controlled oscillator, providing a train of successive polyphase square waves.

6. Apparatus as in claim 5 wherein said receiving means provides a stepped triangle wave from a summation of successive coupled pulses of said train of successive polyphase square waves, said stepped triangle wave embodying information indicative of the position of said movable member with respect to said reference point.

7. Apparatus as in claim 6 wherein said detector means comprises a phase locked loop for providing a TTL signal derived from said stepped triangle wave representing the phase of said stepped triangle wave.

8. Apparatus as in claim 7 wherein said first means coupled to said detector means comprises a plurality of D-type flip-flops and a latching means; and said second means coupled to said first means comprises electronic data processing means.

9. Apparatus for determining the position of a moving print member with respect to a reference point for use in a printer, said apparatus comprising:

signal generator means for providing a train of successive polyphase pulses and a train of successive reference pulses, said train of successive polyphase pulses comprising a plurality of pulses electrically separated in phase;

transmitting means for transmitting said polyphase pulse train;

receiving means capacitively coupled to the transmitting means for receiving said transmitted polyphase pulse train and providing a signal resulting from a summation of successively coupled pulses of said polyphase pulse train, the phase of said signal embodying information indicative of the position of the moving print member with respect to said reference point;

detector means coupled to the receiving means for providing a TTL signal, said TTL signal derived from said signal and indicative of the phase of said signal;

first means coupled to the detector means for comparing said TTL signal with the reference pulse train to provide a first signal indicative of a first incremental position change of the moving print member and a second signal representing a second incremental position change of the moving print member;

second means coupled to said first means for comparing the first incremental position change with said second incremental position change and providing a first output representing an incremental position change of the moving print member when said position changes are occurring in the direction of motion of the moving print member and said first position change being one increment away from said second position change and providing a second output signal representing the direction of motion of the moving print member, and providing a third output signal representing a change of direction of the motion of the moving print bar; and programmed data processing means responsive to said first output signal, to said second output signal and to said third output signal, coupled to the moving print member, for providing print position signals to the moving print member to print predetermined marks at predetermined positions on a printing medium.

10. The apparatus as in claim 9 wherein said transmitting means comprises a plurality of electrically conducting transmitter plates, each of said transmitter plates comprising a plurality of conducting electrodes disposed in a first plane; and said receiving means comprises a plurality of electrically conducting receiver plates disposed in a second plane, each receiver plate capacitively coupled to at least one transmitter plate.

11. The apparatus as in claim 10 wherein each transmitter plate of said plurality of transmitter plates transmits one pulse of said plurality of pulses of said train of successive polyphase pulses.

12. The apparatus as in claim 11 wherein said transmitting means is fixedly attached to said reference point, the axis of motion of said moving print member in said first plane; and said receiving means disposed on said moving print member, said second plane parallel to said first plane.

13. Apparatus as in claim 12 wherein said printer comprises a dot matrix printer.

14. Apparatus as in claim 13 wherein said programmed data processing means comprise:

a program memory for storing executable program code and a plurality of output tables corresponding to selected print dot densities;

counter means responsive to said first output signal for counting incremental changes of position of the moving print member for providing print position signals in accordance with data stored in a selected output table of the plurality of output tables; and means responsive to the third output signal whereby said print position signals in accordance with data stored in a selected output table commencing at the beginning of said output table in response to each third output signal, and for computing an error signal utilized to establish an absolute reference point for the moving print member position in response to each third output signal.

15. Apparatus as in claim 14 wherein said programmed data processing means comprises a microprocessor.

* * * * *

UNITED STATES PATENT AND TRADEMARK OFFICE

CERTIFICATE OF CORRECTION

PATENT NO. : 4,522,517

DATED : June 11, 1985

INVENTOR(S) : Kenneth B. Wade et al

It is certified that error appears in the above-identified patent and that said Letters Patent is hereby corrected as shown below:

Column 4, line 30 of the Patent, after "one", insert --dot--.

Column 12, line 25 of the Patent, delete "or" (first occurrence), insert --to--.

Column 13, lines 21-24 of the Patent, delete the equation "DELTA J = (K=J)/2", insert the equation --DELTA J = (K-J)/2--.

Signed and Sealed this

Fourteenth Day of April, 1987

*Attest:*

DONALD J. QUIGG

*Attesting Officer*

*Commissioner of Patents and Trademarks*